United States Patent [19]

Litt

[11] 4,038,715

[45] Aug. 2, 1977

[54] SCARIFYING TOOL FOR PIPE ENDS

[76] Inventor: Sanford Litt, 27050 Cedar Road, Beechwood, Ohio 44122

[21] Appl. No.: 670,346

[22] Filed: Mar. 25, 1976

[51] Int. Cl.[2] ..... A46B 3/18; A46B 7/00

[52] U.S. Cl. ..... 15/106; 15/104.03; 15/206

[58] Field of Search ..... 15/104.03, 104.04, 104.05, 15/104.2, 106, 111, 160, 164, 206, 143, 145, 105

[56] References Cited

U.S. PATENT DOCUMENTS 2,510,376 6/1950 Burch ..... 15/206

FOREIGN PATENT DOCUMENTS 367,841 1/1923 Germany 17,198 of 1897 United Kingdom ..... 15/206

*Primary Examiner*—Edward L. Roberts

*Attorney, Agent, or Firm*—Fay & Sharpe

[57] ABSTRACT

A tool for scarifying the ends of pipe or the like includes a generally rigid body member adapted to be held in a person's hand for manipulation. The body member has opposite ends and includes a longitudinal axis extending across such ends. Wire brushes are secured to the body member against axial and rotational movement relative thereto in outwardly extending relationship to the opposite ends, and with the longitudinal axes of the brushes extending generally parallel to the longitudinal axis of the body member.

9 Claims, 3 Drawing Figures

SCARIFYING TOOL FOR PIPE ENDS

BACKGROUND OF THE INVENTION

This invention pertains to the art of scarifying tools and, more particularly, to scarifying tools of the hand held type.

The invention is particularly applicable to scarifying tools for scarifying the ends of pipe or the like and will be described with particular reference thereto. However, it will be appreciated that the invention has broader aspects and the tool may be used for scarifying members other than pipes.

Prior to soldering or adhesively joining the ends of metal or plastic pipe and fittings, it is common to scarify the inner and outer ends of the pipes and fittings for cleaning and deburring those surfaces which receive the solder or adhesive. Various scarifying tools have been developed for performing scarifying operations of this type. U.S. Pat. No. 3,168,799 issued Feb. 9, 1965, to Johnson discloses an abrasive tool wherein a plurality of abrasive members have abrasive grit on the outer surfaces thereof. The individual abrasive members must be tapped and threaded for receiving threaded extensions on the tool and for receiving setscrews to lock the abrasive members in position. Tapping and threading are expensive procedures. Abrasive grit tends to become worn away or clogged so it loses it effectiveness quite rapidly. U.S. Pat. No. 3,557,496 issued Jan. 26, 1971, to Martin discloses an abrasive tool wherein a highly flexible body member has abrasive projections secured to its opposite ends by screws. It is rather difficult to use the abrasive end projections when the body member is highly flexible. Securing the abrasive projections to the body member with axially extending screws creates the possibility that the screws and abrasive projections will become loose during use. The abrasive grit also loses its effectiveness by wearing away or becoming clogged. U.S. Pat. No. 3,634,982 issued Jan. 18, 1972, to Martin discloses an abrasive tool wherein the opposite ends have projections integral with the body member. The abrasive grit is either bonded to the projections or is mixed in the material from which the tool is molded. Abrasive projections using grit often make line contact with a pipe end so that the pipe end is not fully cleaned around its full circumference or along the length of the end portion to be joined.

It would be desirable to have an arrangement wherein scarifying devices could be secured to a body member in an inexpensive manner. It would also be desirable to have an arrangement which would permit the use of wire brushes which are often longer lasting than abrasive grit and perform a more thorough scarifying operation.

SUMMARY OF THE INVENTION

A tool for scarifying the ends of pipe or similar, generally cylindrical surface areas includes a generally rigid body member adapted to be held in a person's hand for manipulation. The body member has opposite ends and a longitudinal axis extends across such ends. Wire brushes defining scarifying devices are manufactured separate from the body member and are secured to the body member against axial and rotational movement relative thereto in outwardly extending relationship to the opposite ends of the body member. The brushes have longitudinal brush axes extending generally parallel to the longitudinal axis of the body member and generally circular cross-sectional configurations perpendicular to the brush axes.

In a preferred arrangement, the brushes or other scarifying devices include integral mounting means extending outwardly therefrom for mounting the scarifying devices to the body member. The brushes may be of the type including central twisted wire spines having wire bristles secured thereto along a portion of the spine length so that the remainder of the spine length defines the mounting means.

The body member is preferably formed in a pair of parts which are joined together on joining surfaces extending generally parallel to the longitudinal axis of the body member. The pair of parts are preferably substantially identical halves. With the brushes or scarifying devices having integral mounting means extending outwardly therefrom, the pair of parts have receiving means along their joining surfaces for receiving the mounting means. The receiving means may comprise grooves having longitudinal groove portions extending generally parallel to the longitudinal axis of the body member and transverse groove portions extending transversely of the longitudinal groove portions. The mounting means includes longitudinal and transverse mounting portions respectively received in the longitudinal and transverse groove portions.

The pair of parts forming the body member may be separably secured together for easy replacement of the scarifying devices.

It is a principal object of the invention to provide an improved scarifying tool for pipe ends or similar generally cylindrical members.

It is another object of the invention to provide such a scarifying tool which is very economical to manufacture and assemble.

It is still another object to provide such a scarifying tool in which it is inexpensive and simple to replace the operative component parts as they become worn.

It is a further object of the invention to provide such a tool having projecting wire brushes secured thereto without the use of threaded fasteners such as setscrews or the like.

BRIEF DESCRIPTION OF THE DRAWING

The invention may take physical form in certain parts and arrangements of parts, a preferred embodiment of which will be described in detail in this specification and illustrated in the accompanying drawings which form a part hereof and wherein.

DESCRIPTION OF A PREFERRED EMBODIMENT

Figure 1:
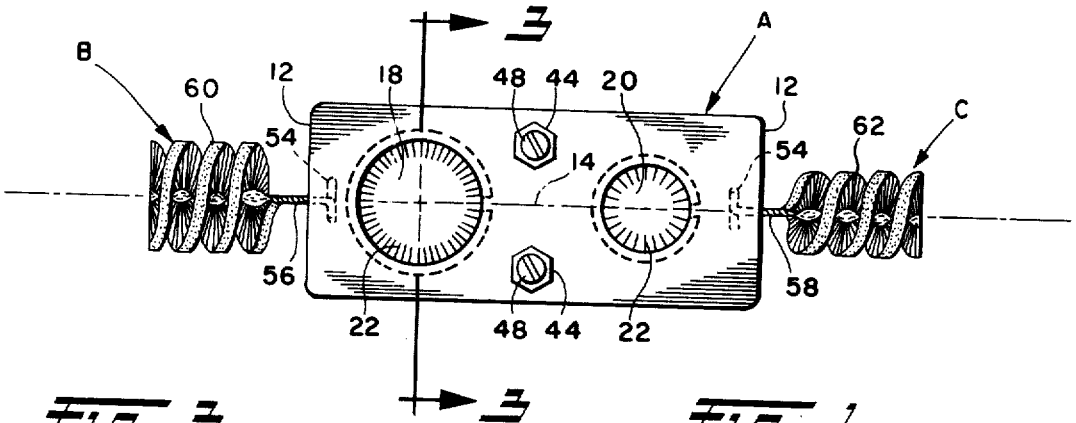
FIG. 1 is a plan view of a scarifying device constructed in accordance with the present invention.

Referring now to the drawings wherein the showings are for purposes of illustrating a preferred embodiment of the invention only and not for purpose of limiting same, FIG. 1 shows a scarifying tool including a body member A which is preferably dimensioned and shaped for being held in a person's hand for manipulation. Body member A includes opposite ends 12 across with a longitudinal axis 14 extends. Wire brushes B and C are secured to body member A against axial and rotational movement relative thereto, and are positioned in outwardly extending relationship to opposite ends 12. Wire brushes B and C have longitudinal brush axes parallel to longitudinal axis 14, and in the arrangement shown, the longitudinal brush axes are coincidential with longitudinal axis 14.

Spaced-apart different sized holes 18, 20 lying along axis 14 extend through body member A. Holes 18, 20 are lined with generally radially inwardly extending wire bristles indicated by numeral 22. Pipe ends are extendable through holes 18, 20 and rotational manipulation of the tool about the axis of the hole through which the pipe end extends will then scarify the pipe end by action of wire bristles 22.

Figure 2:
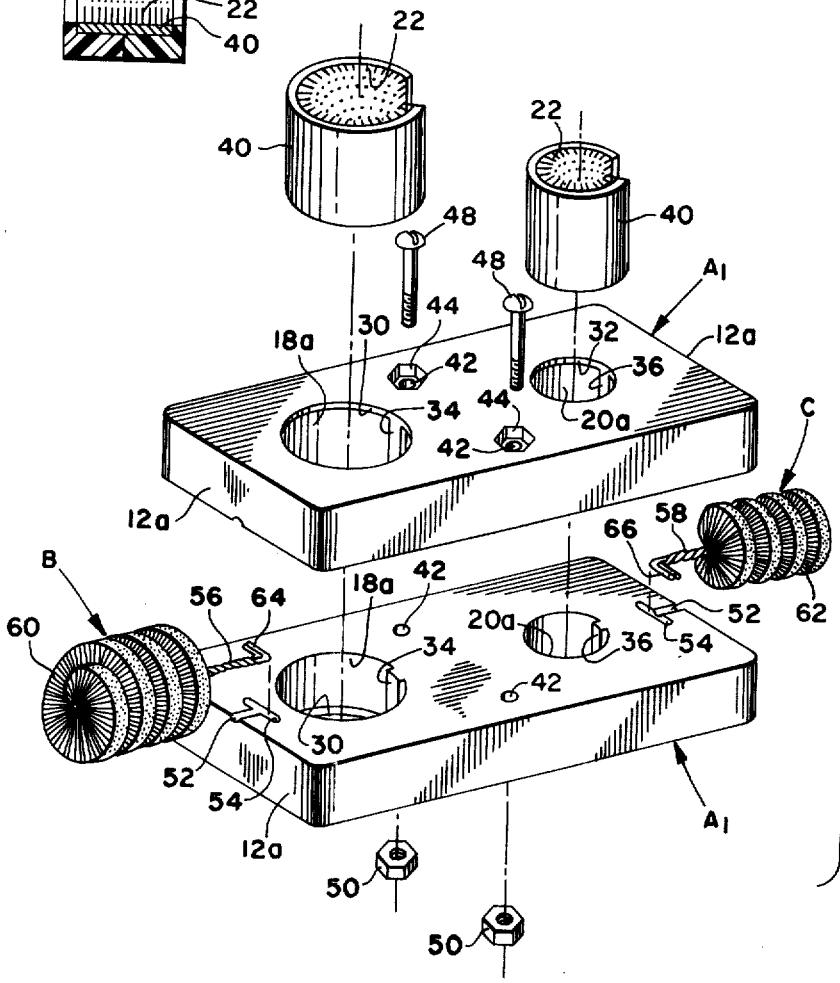
FIG. 2 is a perspective illustration thereof.

As best shown in FIG. 2, body member A of FIG. 1 is assembled from a pair of substantially identical half parts $A_1$. Each half part $A_1$ has an outer surface 26 and an opposite plane joining surface 28. Holes 18*a*, 20*a* through each half part $A_1$ cooperate with one another in the assembled condition of the half parts to define holes 18, 20 in body member A.

Figure 3:
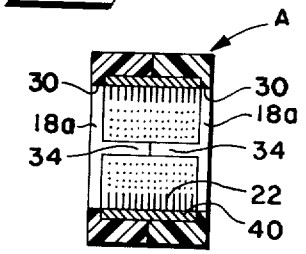
FIG. 3 is a partial cross-sectional elevational view taken generally along lines 3—3 of FIGS. 1.

As best shown in FIG. 3, each hole 18*a* has an inwardly extending flange 30 adjacent the ends thereof closest to outer surface 26. Hole 20*a* has a similar flange 32. A relatively narrow vertical rib or the like 34, 36 may extend the length of each hole 18*a*, 20*a* so that the circumference of each hole beneath its flange 30, 32 is somewhat less than 360°.

Backing strips 40 of cardboard, canvas, rubber-like material or the like have wire bristles 22 secured thereto and extending inwardly therefrom. Strips 40 are deformable for insertion into holes 18 and 20. Strips 40 have a length and width to fit snuggly within the holes between flanges 30, 32 when parts $A_1$ are assembled together to form body member A. The ends of strips 40 abut ribs 34, 36 to prevent rotation of the strips relative to the holes. The strips could be adhesively secured in the holes and other types of abrasive material could also be employed to line the holes.

Suitable holes 42 through each part $A_1$ have polygonal counterbores 44 adjacent outer face 26. Screws 48 extend through holes 42 for cooperation with nuts 50 received in polygonal counterbores 44 to secure half parts $A_1$ together to form the scarifying tool. The heads of screws 48 are dimensioned to fit within counterbores 44 in order that the outer surfaces of body member A will have no projecting screw or nut portions.

Joining surface 28 has generally T-shaped grooves therein adjacent opposite ends 12*a*. These grooves include a longitudinal groove portion 52 intersecting a transverse groove portion 54. Longitudinal groove portions 52 extend to ends 12*a* and are parallel to longitudinal axis 14. Each brush B and C includes a twisted wire spine 56, 58 respectively in which wire bristles 60, 62 are secured. Axially elongated brushes B and C include spine end portions which extend beyond bristles 60, 62 and terminate in transverse spine end portions 64, 66 respectively. Therefore, the portions of spines 56, 58 extending longitudinally beyond bristles 60, 62 are receivable in longitudinal groove portions 52 while transverse spine portions 64, 66 are receivable in transverse groove portions 54 on one side of longitudinal groove portion 52.

The bare length of each spine 56 and 58 extending beyond bristles 60 and 62 may be considered an integral mounting means which projects or extends outwardly form each scarifying device B or C. This mounting means includes longitudinal and transverse mounting portions. Parts $A_1$ have receiving means for receiving the mouting means on the scarifying devices. The receiving means comprises longitudinal grooves 52 and transverse grooves 54 which respectively receive the longitudinal and transverse mounting portions.

Although body member A is shown in the FIGS. as being rectangular, other various shapes may be used so as to accomodate the body portion to a person's hand without departing from the intent or scope of the present invention. The parts forming the body member are preferably molded of relatively rigid synthetic plastic material although other materials could also be advantageously employed. It will also be recognized that parts $A_1$ may be alternatively secured together by ultrasonic welding, adhesive, rivets and the like.

One part $A_1$ is rotated 180° or flipped about axis 14 relative to the other part and the mounting portions of brushes B and C are positioned in the grooves. The two parts are then secured together. Strips 40 may then be positioned in holes 18 and 20. Brushes B and C have longitudinal brush axes which are substantially coincidental with axis 14 of body member A. In general, it may be said that the longitudinal axes of the brushes extend substantially parallel to longitudial axis 14. Brushes B and C preferably have circular cross-sectional configurations perpendicular to their longitudinal axes. In a preferred arrangement, brushes B and C are generally cylindrical, although it is possible to utilize brushes having the general shape of truncated cones.

Brushes B and C are preferably of different sizes so that one could be used to scarify the inner end portion of one size pipe while the other would be used to scarify the inner end portion of another size pipe. In the arrangement using screws and nuts or other separable fasteners for holding parts $A_1$ together, it is possible to remove or replace brushes B and C. With wire bristles 60 and 62 extending along only a portion of the length of spines 56 and 58, the remainder of those spines define the integral mounting means extending outwardly from the brushes. The longitudinal and transverse mounting portions of the brushes are firmly trapped between the two parts forming body member A so that the brushes cannot rotate or move axially relative to the body member. Joining surfaces 28 extend parallel to longitudinal axis 14. Even though only one leg of transverse groove portion 54 is required for receiving transverse mounting portion 64 or 66, the grooves are T-shaped in order that the two parts may be substantially identical and one may be flipped.

In addition to scarifying the ends of pipe or tubing as hereinabove described, the subject hand tool may also be advantageously employed for many other purposes. For example, it may also be used to scarify battery terminals, battery cable ends and the like. Moreover, it may also be used in any environment where a generally cylindrical internal and/or external surface area is to be scarified.

The invention has been described with reference to a preferred embodiment. Obviously, modifications and alternation will occur to others upon the reading and understanding of this specification. It is my intention to include all such modifications and alternations insofar as they come within the scope of the appended claims or the equivalents thereof.

Having thus described my invention, I now claim:

1. A tool for scarifying at least the ends of generally cylindrical areas comprising; a generally rigid body member having a longitudinal axis extending across opposite ends and being adapted to be held in a person's hand for manipulation, wire brushes manufactured separate from said body member and being secured to said body member against axial and rotational movement relative thereto in outwardly extending relationship to said opposite ends, said brushes having longitudinal brush axes extending generally parallel to said longitudinal axes of said body member and having generally circular cross-sectional configurations perpendicular to said brush axes, and at least one hole in said body member intermediate said ends extending transversely of said body member and being lined with abrasive material for receiving the ends of generally cylindrical members to abrade the exterior surfaces of same.

2. The tool as defined in claim 1 wherein said body member has opposite outer surfaces across which said hole extends, flanges extending inwardly of said hole adjacent said outer surfaces, and said abrasive material being on a carrier positioned in said hole between said flanges.

3. the tool as defined in claim 1 wherein said body member is formed in a pair of parts joined together on joining surfaces extending generally parallel to said longitudinal axis of said body member, said brushes having mounting means positioned between said parts along said joining surfaces and said mounting means being positionable between said parts and removable therefrom only when said parts are separated.

4. The tool as defined in claim 3 wherein said pair of parts are substantially identical halves.

5. A half part cooperable with a like part to form a body member for a hand held scarifying tool, each said part having opposite joining and outer surfaces and opposite ends, a hole through said part intermediate said ends across said joining and outer surfaces, a flange extending inwardly of said hole adjacent said outer surface, and receiving means in said joining surface extending inwardly from at least one of said ends for receiving a mounting means on a scarifying device, said half part being cooperable with said like part by joining the parts together with their joining surfaces in engagement after a mounting means on a scarifying device is positioned therebetweeen for reception in said receiving means, the parts having the holes therein aligned for receiving an abrasive material carrier between the flanges adjacent the outer surfaces of the parts.

6. The part as defined in claim 5 including a narrow rib extending along said hole between said flange and said joining surface.

7. A hand held scarifying tool comprising; a substantially rigid body member having a longitudinal axis, opposite outer surfaces and opposite ends, scarifying devices manufactured separate from said body member and secured thereto against rotational and axial movement in outwardly extending relationship to said opposite ends, a hole through said body member across said outer surfaces intermediate said ends, abrasive material lining said hole, said body member being formed from two parts joined together along joining surfaces extending across said ends substantially parallel to said outer surfaces, said scarifying devices having mounting means trapped between said joining surfaces.

8. The tool as defined in claim 7 including flanges extending inwardly of said hole adjacent said outer surfaces, and said abrasive material being on a carrier received in said hole between said flanges.

9. The tool as defined in claim 8 including a narrow rib extending along said hole between said flanges, said carrier having carrier ends located on opposite sides of said rib.

* * * * *